US012227892B2

(12) United States Patent
Kwon et al.

(10) Patent No.: US 12,227,892 B2
(45) Date of Patent: Feb. 18, 2025

(54) WASHING MACHINE

(71) Applicant: SAMSUNG ELECTRONICS CO., LTD., Suwon-si (KR)

(72) Inventors: Baekgyu Kwon, Suwon-si (KR); Minhyung Kim, Suwon-si (KR); Naeyoung Park, Suwon-si (KR); Jonghun Sung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 232 days.

(21) Appl. No.: 17/748,766

(22) Filed: May 19, 2022

(65) Prior Publication Data

US 2022/0290358 A1 Sep. 15, 2022

Related U.S. Application Data

(63) Continuation of application No. PCT/KR2020/016680, filed on Nov. 24, 2020.

(30) Foreign Application Priority Data

Nov. 26, 2019 (KR) ..... 10-2019-0153113
Nov. 23, 2020 (KR) ..... 10-2020-0157554

(51) Int. Cl.
*D06F 39/14* (2006.01)
*D06F 37/42* (2006.01)

(52) U.S. Cl.
CPC ..... *D06F 39/14* (2013.01); *D06F 37/42* (2013.01)

(58) Field of Classification Search
CPC ..... D06F 39/14; D06F 37/42
USPC ..... 68/3 R
See application file for complete search history.

(56) References Cited

U.S. PATENT DOCUMENTS

2004/0163426 A1 8/2004 Kim et al.
2017/0260678 A1 9/2017 Wee et al.
2018/0363200 A1* 12/2018 Gim ..... D06F 37/206

FOREIGN PATENT DOCUMENTS

CN 106048989 B * 11/2018 ..... B29C 45/00
CN 110359235 A 10/2019
KR 10-1310331 10/2013
KR 10-2016-0146194 A 12/2016
KR 10-1745891 B1 6/2017
KR 10-2018-0136085 A 12/2018
KR 10-2018-0136086 A 12/2018
KR 10-2018-0136087 A 12/2018
KR 10-2018-0136088 A 12/2018
KR 10-2018-0136094 A 12/2018
(Continued)

OTHER PUBLICATIONS

CN106048989B—machine translation (Year: 2018).*
(Continued)

*Primary Examiner* — Tinsae B Ayalew
(74) *Attorney, Agent, or Firm* — STAAS & HALSEY LLP

(57) ABSTRACT

The present disclosure relates to a washing machine including a cabinet including a front panel in which a laundry inlet is formed, a door coupled to the front panel to open and close the laundry inlet, a door-lock disposed on a rear of the front panel and coupleable with the door to maintain the door in a closed state, a cover member mounted on a rear surface of the front panel to cover the door-lock, and a sealing member sealing a gap between the cover member and the rear surface of the front panel.

9 Claims, 16 Drawing Sheets

(56) References Cited

FOREIGN PATENT DOCUMENTS

| | | | |
|---|---|---|---|
| KR | 10-2018-0136095 | A | 12/2018 |
| KR | 10-2018-0136104 | A | 12/2018 |
| KR | 10-2018-0136107 | A | 12/2018 |
| KR | 10-2018-0136108 | A | 12/2018 |
| KR | 10-2019-0125647 | A | 11/2019 |

OTHER PUBLICATIONS

International Search Report dated Mar. 18, 2021 in International Application No. PCT/KR2020/016680.
European Search Report dated Nov. 24, 2022, in European Application No. EP 20 89 4273.
European Office Action dated May 21, 2024 for European Application No. 20894273.0.

* cited by examiner

WASHING MACHINE

CROSS-REFERENCE TO RELATED APPLICATIONS

This application is a continuation of International Application PCT/KR2020/016680 filed Nov. 24, 2020, and is based on and claims priority under 35 U.S.C. § 119 to Korean Patent Application No. 10-2019-0153113 filed Nov. 26, 2019, and Korean Patent Application No. 10-2020-0157554 filed Nov. 23, 2020. The disclosures of International Application PCT/KR2020/016680, Korean Patent Application No. 10-2019-0153113, and Korean Patent Application No. 10-2020-0157554, are incorporated by reference herein by reference in their entireties.

BACKGROUND

1. Field

The present disclosure relates to a washing machine capable of preventing moisture from penetrating into a door-lock.

2. Description of Related Art

In general, a washing machine is a machine that washes clothes using electric power, and as a type of washing machine, there are a drum washing machine in which laundry is washed by falling down after being lifted upward along an inner circumferential surface of a rotating tub as the rotating tub, which is disposed horizontally, rotates in forward and reverse directions with respect to a horizontal axis and a vertical axis washing machine in which laundry is washed using a water current generated by a pulsator disposed inside a rotating tub when the rotating tub disposed vertically rotates in forward and reverse directions with respect to a vertical axis.

In general, a drum washing machine includes a cabinet, a tub storing washing water inside the cabinet, and a drum accommodating laundry and rotatably installed inside the tub. An opening is provided on the cabinet, and the opening is provided to be opened and closed by a door.

In a state in which laundry, detergent, and washing water are fed into the drum, the drum rotates to agitate the laundry with the washing water, thereby removing grime on the laundry. Laundry is fed through the opening of the cabinet, and detergent and washing water are supplied by a detergent supply device.

In the case of such a drum washing machine, the door is kept closed by a door-lock so that the door is not opened during washing.

On the other hand, when a user sprays water toward a front panel, an upper panel, and the like of a washing machine to clean an exterior of the washing machine, the water may penetrate into the door-lock so that safety accidents such as fire may occur.

SUMMARY

Aspects of the present disclosure will be set forth in part in the description which follows and, in part, will be apparent from the description, or may be learned by practice of the presented embodiments.

An aspect of the present disclosure provides a washing machine including a cabinet including a front panel in which a laundry inlet is formed, a door coupled to the front panel to open and close the laundry inlet, a door-lock disposed on a rear of the front panel and coupleable with the door to maintain the door in a closed state, a cover member mounted on a rear surface of the front panel to cover the door-lock, and a sealing member sealing a gap between the cover member and the rear surface of the front panel.

The cover member may include an upper surface covering an upper end of the door-lock, and an upper flange facing the rear surface of the front panel on a side of the upper surface.

The sealing member may include a body coupled to the upper flange, and a lip formed integrally with the body and inclined upward toward the rear surface of the front panel.

The sealing member may include an elastic material.

The lip may form a first angle with respect to the body.

The lip may be deformed as the lip comes into contact with the rear surface of the front panel to form a second angle smaller than the first angle with respect to the body and to be in close contact with the rear surface of the front panel.

The first angle may be formed in a range of 120 degrees to 135 degrees.

Each of the body and the lip may have a thickness of 1 mm.

The sealing member may be insert-injected onto the upper flange.

The body may be adhered to the upper flange through an adhesive.

A coupling groove may be formed on the upper flange to allow the body to be fitted to the upper flange.

The cover member may include a side surface covering a side of the door-lock, and a lower flange facing the rear surface of the front panel on a side of the side surface.

Another aspect of the present disclosure provides a washing machine including a cabinet including a front panel in which a laundry inlet is formed, a door coupled to the front panel to open and close the laundry inlet, a door-lock mounted on a rear surface of the front panel and coupleable with the door to maintain the door in a closed state, a cover member mounted on the rear surface of the front panel to cover the door-lock, and a sealing member sealing a gap between at least one of an upper surface and a side surface of the cover member and the rear surface of the front panel.

The upper surface may include an upper flange formed on a side thereof to face the rear surface of the front panel, and the side surface may include a lower flange formed on a side thereof to face the rear surface of the front panel.

The sealing member may include a body coupled to at least one of the upper flange and the lower flange, and a lip bent from the body and inclined upward toward the rear surface of the front panel.

The sealing member may include an elastic material.

The lip may form an angle within a range of 120 degrees to 135 degrees with respect to the body.

The sealing member may be insert-injected onto at least one of the upper flange and the lower flange.

The body may be adhered to at least one of the upper flange and the lower flange through an adhesive.

A coupling groove may be formed on at least one of the upper flange and the lower flange to allow the body to be fitted.

Another aspect of the present disclosure provides a washing machine including a cabinet including a front panel in which a laundry inlet is formed, a door coupled to the front panel to open and close the laundry inlet, a door-lock disposed on a rear of the front panel and coupleable with the door to maintain the door in a closed state, a cover member mounted on a rear surface of the front panel to cover the door-lock, and an auxiliary cover connected to the cover member and provided to block water flowing along an upper end of the cover member from penetrating into the door-lock when positioned inside the cover member.

The auxiliary cover may be provided to be folded or unfolded with respect to the cover member.

The auxiliary cover may include a connection part provided to be foldable on one side surface of the cover member, and an auxiliary part connected to the connection part to block water from penetrating into the door-lock when the connection part is positioned below the upper end of the cover member in a folded state.

The connection part may include a bent portion provided on one side and first and second extension portions connected to opposite sides of the bent portion, and the bent portion may have a thickness smaller than a thickness of each of the first and second extension portions.

A groove may be provided on one surface of the connection part, and the connection part may be folded around the groove.

The washing machine may further include a rib provided around the groove to connect the other surface of the connection part and a side surface of the cover member.

The connection part may include a bent portion having a semicircle or arc shape and first and second extension portions connected to opposite sides of the bent portion, the bent portion may have a thickness smaller than a thickness of each of the first and second extension portions, and the connection part may be folded around the bent portion.

The auxiliary part may include an upper plate positioned to face an upper surface of the cover member when the connection part is folded, and a front plate connected to the upper plate and positioned to face the front panel.

The upper plate may be provided to be inclined upward toward a rear surface of the cover member.

A protrusion protruding toward a front surface of the front plate to prevent from the water flowed along the upper plate to fall may be provided at an end of the front plate.

The auxiliary part may further include a hook member provided to be coupled and fixed to the other side surface of the cover member when the connection part is folded.

The cover member and the auxiliary cover may be manufactured by an injection mold.

BRIEF DESCRIPTION OF THE DRAWINGS

The above and other aspects, features, and advantages of embodiments of the present disclosure will be more apparent from the following description taken in conjunction with the accompanying drawings, in which.

DETAILED DESCRIPTION

Figure 1:
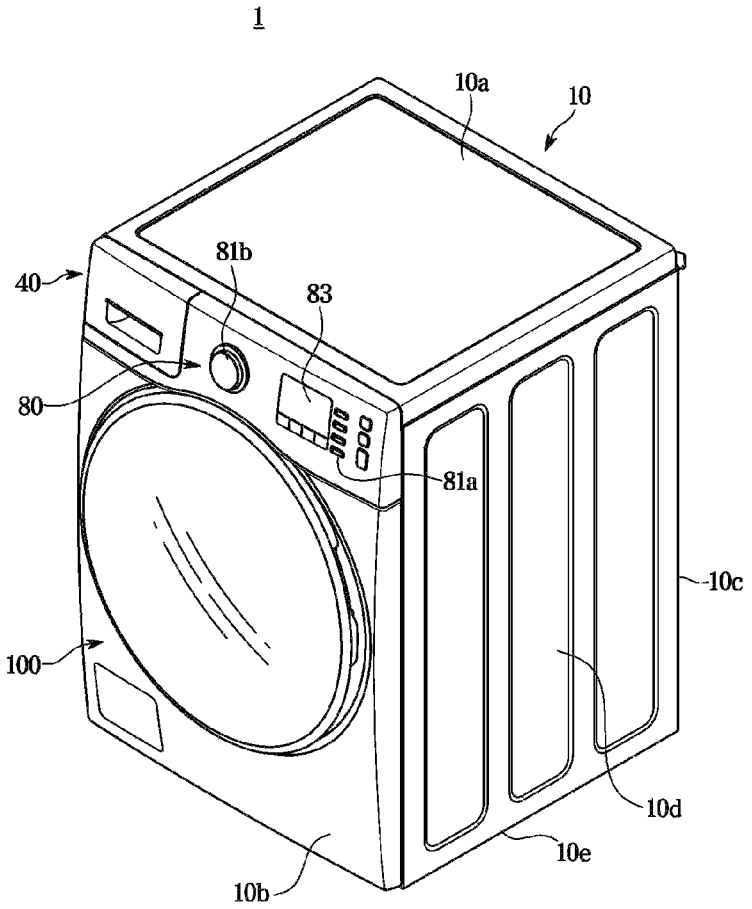
FIG. 1 is a perspective view of a washing machine according to an embodiment of the present disclosure.

The embodiments described in the present specification and the configurations shown in the drawings are only examples of embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Various embodiments of the present disclosure are directed to providing a washing machine capable of blocking water from penetrating into a door-lock when a user sprays the water into the washing machine to clean an exterior of the washing machine.

Further, various embodiments of the present disclosure are directed to providing a washing machine capable of preventing the occurrence of safety accidents such as fire due to penetration of moisture into a door-lock.

A washing machine according to various embodiments of the present disclosure may prevent the occurrence of safety accidents, such as fire, by blocking water introduced into the washing machine from the outside from penetrating into a door-lock.

Further, a washing machine according to various embodiments of the present disclosure may block the penetration of water into the door-lock simply by providing a sealing member at an upper end of a cover member without a separate device, so that the washing machine can have a further simple structure and the manufacturing cost can be lowered.

Figure 2:
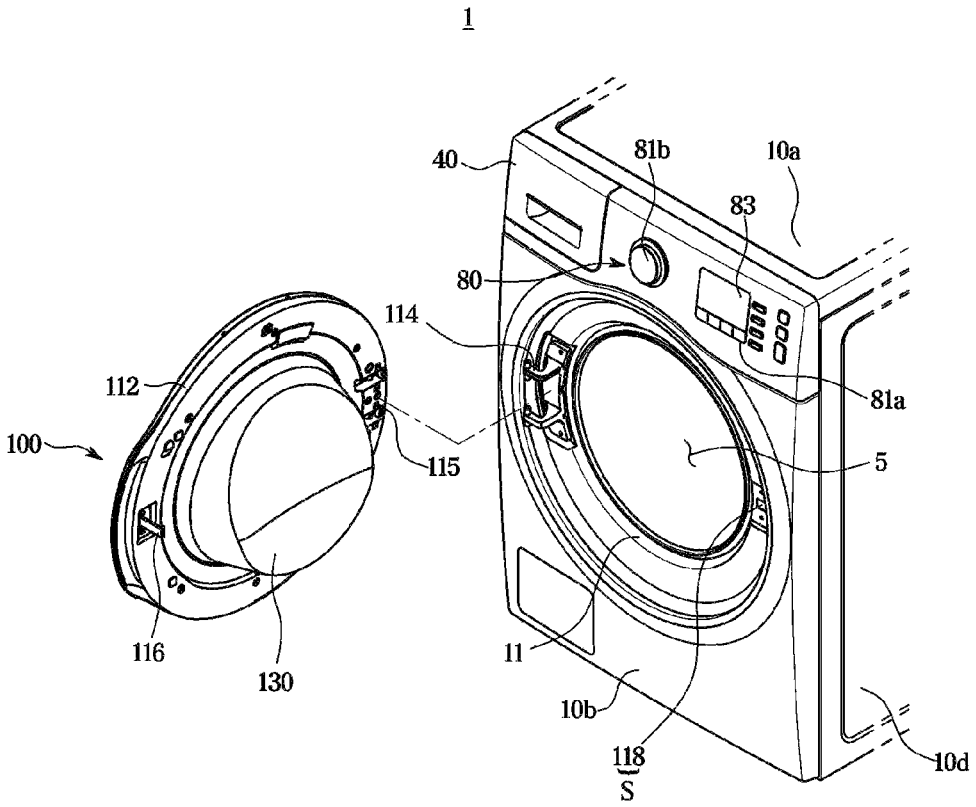
FIG. 2 is an exploded perspective view in which a door of the washing machine of FIG. 1 is separated from a cabinet.
Figure 3:
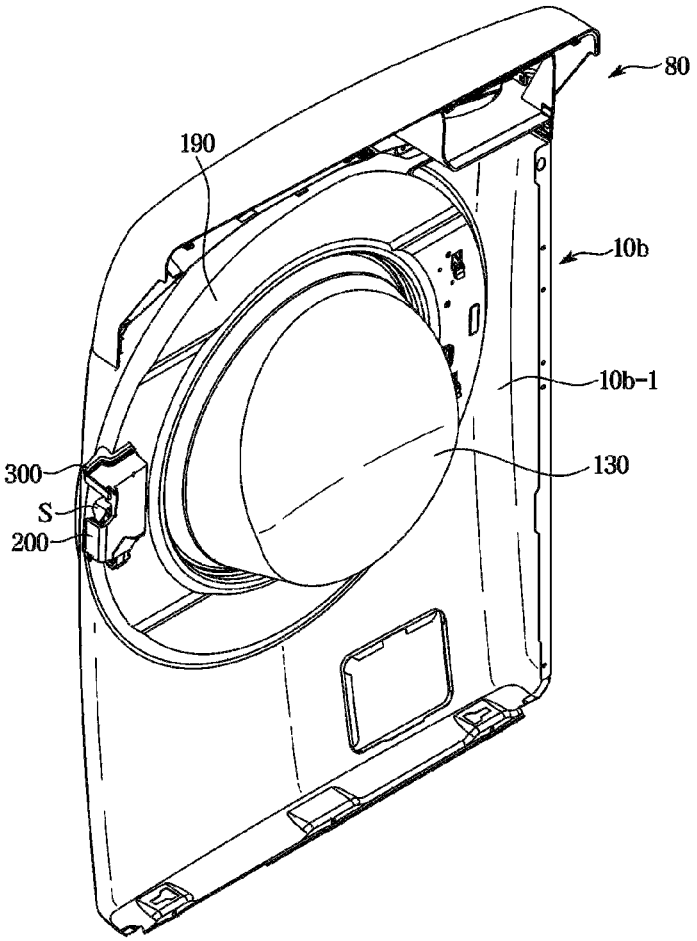
FIG. 3 is a perspective view illustrating a front panel, a cover member, and a sealing member of the washing machine of FIG. 1.
Figure 4:
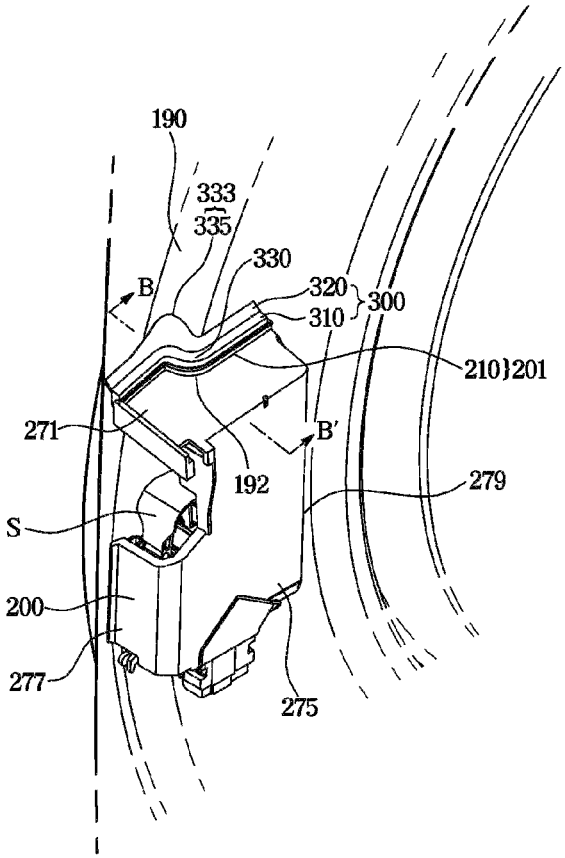
FIG. 4 is an enlarged perspective view of the cover member and the sealing member of FIG. 3.
Figure 5:
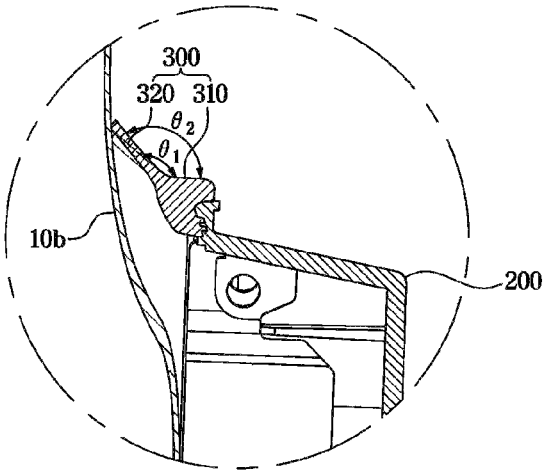
FIG. 5 is a cross-sectional view taken along line B-B' of FIG. 4.

FIG. 1 is a perspective view of a washing machine according to an embodiment of the present disclosure, FIG. 2 is an exploded perspective view in which a door of the washing machine of FIG. 1 is separated from a cabinet, FIG. 3 is a perspective view illustrating a front panel, a cover member, and a sealing member of the washing machine of FIG. 1, FIG. 4 is an enlarged perspective view of the cover member and the sealing member of FIG. 3, and FIG. 5 is a cross-sectional view taken along line B-B' of FIG. 4.

Referring to FIGS. 1 to 3, the washing machine 1 includes a cabinet 10 forming a washing space 5 therein, a tub (not shown) to store washing water or rinsing water to be used in a washing process or a rinsing process, and a driving motor (not shown) to rotate the drum (not shown). The washing space 5 inside the cabinet may be formed by the tub and the drum.

The cabinet 10 includes an upper panel 10*a*, a front panel 10*b*, a rear panel 10*c*, and a side panel 10*d* constituting an upper, front, rear and side surfaces of the cabinet, respectively.

A control panel 80 including input parts 81*a* and 81*b* to receive an operation command of the washing machine 1 from a user and a display part 83 to display operation information of the washing machine 1 is provided at an upper portion of the front panel 10*b*.

In the center of the front panel 10*b* below the control panel 80, a laundry inlet 11 for putting laundry into the drum 30 is provided, and a door 100 provided to open and close the laundry inlet 11 is hinged to the front panel 10*b*.

The door 100 is provided to correspond to the laundry inlet 11, and may be provided rotatably with respect to the cabinet 10. The door 100 may include a door frame 112 and a door glass 130.

The door frame 112 is configured in a substantially annular shape, but may also be configured in a substantially rectangular shape.

The door glass 130 may be formed of a transparent material so that the inside of the drum may be seen from the outside of the washing machine even when the door 100 closes the laundry inlet 11. The door glass 130 may be disposed to convexly protrude from the door frame 112 toward the inside of the cabinet 10. Through this configuration, the door glass 130 may be inserted into the laundry inlet 11 when the door 100 is closed.

A hinge 114 is provided around the laundry inlet 11 so that the door 100 may rotate with respect to the cabinet 10, so that the hinge 114 is coupled to a hinge coupling part 115 formed on one side of the door 100. A hook 116 is provided on the other side of the door frame 112, and a door-lock S including a hook accommodating portion 118 corresponding to the hook 116 is provided on the front panel 10*b*, so that the door 100 may be maintained in a state of closing the laundry inlet 11.

That is, the door-lock S is coupled to a rear surface of the door 100 by allowing the hook 116, which is provided on the rear surface of the door 100, to be accommodated in the hook accommodating portion 118 when the door 100 closes the laundry inlet 11, thereby maintaining the door 100 in a closed state. In other words, as the hook 116 is inserted into a main body of the door-lock S to be fixed to the main body of the door-lock S, the door frame 112 may be maintained in a state of closing the laundry inlet 11.

When the user sprays water from the outside of the washing machine 1 toward the front panel 10*b* to clean an exterior of the washing machine 1, the water may be introduced into the washing machine 1 through a gap between the front panel 10*b* and the control panel 80. Also, when the user sprays water toward the upper panel 10*a* or the side panel 10*d* of the washing machine 1, the water may be introduced into the washing machine 1. As such, as the user sprays water toward the washing machine 1, the water introduced into the washing machine 1 may fall and penetrate into the door-lock S, and when the water penetrates through the door-lock S, safety accidents such as fire may occur.

Therefore, in order to prevent the occurrence of safety accidents, as illustrated in FIG. 3, the washing machine 1 may further include a cover member 200 and a sealing member 300 to prevent water from penetrating into the door-lock S.

The cover member 200 is mounted on a rear surface 10*b*-1 of the front panel 10*b* to serve to cover the door-lock S. In this case, the cover member 200 may include an upper surface 271, a lower surface (not shown), a front surface (not shown), a rear surface 275, and opposite side surfaces 277 and 279 to cover the door-lock S.

The upper surface 271 of the cover member 200 may be formed above the door-lock S to cover an upper portion of the door-lock S. Accordingly, when water introduced into the inside of the washing machine 1 from the outside falls from above the door-lock S, moisture does not penetrate into the door-lock S.

The front surface 273 of the cover member 200, which is a surface facing the rear surface of the front panel 10*b*, may cover only a portion of a front portion of the door-lock S. This is to allow the hook accommodating portion 118 formed on the front portion of the door-lock S to penetrate the front panel 10*b* such that the hook 116 provided on the rear surface of the door 100 may be coupled to the hook accommodating portion 118.

The lower surface, the rear surface 275, and the opposite side surfaces 277 and 279 of the cover member 200 may cover a lower portion, a rear portion, and opposite side portions of the door-lock S, respectively.

As such, the cover member 200 may be mounted on the rear surface of the front panel 10*b* to cover the door-lock S so that moisture does not penetrate into the door-lock S.

However, as the cover member 200 is mounted on the rear surface of the front panel 10*b*, there is a possibility that water penetrates into a gap between the cover member 200 and the front panel 10*b* and is introduced into the door-lock S. That is, water may be introduced into a gap between an upper flange 210 on the upper surface 271 of the cover member 200, which is a portion facing the rear surface of the front panel 10*b*, and the front panel 10*b*.

Accordingly, as the sealing member 300 is provided on the upper flange 210 of the cover member 200 to seal the gap between the rear surface of the front panel 10*b* and the upper flange 210 of the cover member 200, the sealing member 300 serves to block water from entering the door-lock S by penetrating into the gap between the cover member 200 and the front panel 10*b*.

More specifically, the upper flange 210 formed on the upper surface of the cover member 200, which is a portion facing the rear surface of the front panel 10*b*, may have a shape corresponding to the rear surface of the front panel 10*b*. For example, as illustrated in FIGS. 3 and 4, when a step 190 having a donut shape is formed on the rear surface 10*b*-1 of the front panel 10*b*, the upper flange 210 may include a concave portion 192 to correspond to the step 190.

The sealing member 300 may be configured to include an elastic material. For example, the sealing member 300 may be made of a material including at least one of rubber, sponge, and silicon.

The sealing member 300 may include a body 310 coupled to the upper flange 210, and a lip 320 integrally formed with the body 310.

The body 310 may be provided on the upper flange 210 of the cover member 200 to face the rear surface 10*b*-1 of the front panel 10*b*. In addition, the body 310 may be formed in a shape corresponding to the upper flange 210 to be coupled to the upper flange 210. For example, when the upper flange 210 of the cover member 200 includes the concave portion 192, the upper flange 210 may have a shape including a first bent portion 330 corresponding to the concave portion 192. Accordingly, the first bent portion 330 may be formed in a shape corresponding to the step 190 to be in close contact with the step 190.

The body 310 may be provided to have a thickness of 1 mm.

The lip 320 may be provided to be inclined upward from the body 310 to form a predetermined angle with respect to the body 310. That is, the lip 320 may be bent upward from the body 310 in a state in which the body 310 is coupled to a first side 210 to form a first angle θ1 with respect to the body 310. In this case, the first angle may be formed within a range of 120 degrees to 135 degrees. The lip 320 may be provided to have a thickness of 1 mm.

As such, when the cover member 200 is mounted on the front panel 10*b* in a state in which the sealing member 300 is coupled to the cover member 200, the lip 320 may be deformed to form a second angle θ2 that is smaller than the first angle θ1 with respect to the body 310 as the lip 320 comes into contact with the front panel 10*b* in a state of being formed at a first angle θ1. At the same time, the lip 320 may be in close contact with the rear surface of the front panel 10*b* by including an elastic material, and thus the lip 320 may more effectively seal the gap between the rear surface of the front panel 10*b* and the cover member 200.

The lip 320 may include a second bent portion 333 to be in close contact with the step 190 like the body 310 in a state of being coupled to the body 310 as described above.

The second bent portion 333 may include a protrusion 335 in which a portion thereof protrudes toward an end of the step 190, that is, an end of the concave portion 192, and thus the second bent portion 333 may be effectively in close contact with the end of the step 190.

As described above, as the gap between the rear surface of the front panel 10*b* and the cover member 200 is sealed by the sealing member 300, when water is introduced into the washing machine 1 from the outside, water may be prevented from falling from an upper end 201 of the cover member 200 and being introduced into the door-lock S located at a lower portion of the cover member 200.

The sealing member 300 may be insert-injected onto the upper end 201 of the cover member 200 through a conventional insert injection molding apparatus. Accordingly, because the sealing member 300 is integrally formed with the cover member 200 when provided on the upper end 201 of the cover member 200 not to form a gap between the sealing member 300 and the cover member 200, the inflow of water between the sealing member 300 and the cover member 200 may be blocked, and thus, the penetration of water into the door-lock S may be blocked more effectively.

Figure 6:
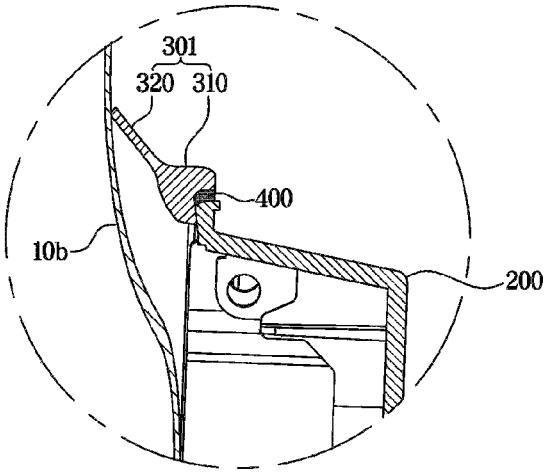
FIG. 6 is a cross-sectional view illustrating a cover member and a sealing member of a washing machine according to another embodiment of the present disclosure.
Figure 7:
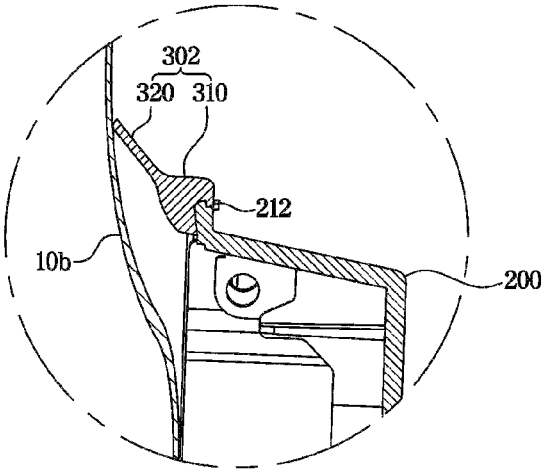
FIG. 7 is a cross-sectional view illustrating a cover member and a sealing member of a washing machine according to another embodiment of the present disclosure.

FIG. 6 is a cross-sectional view illustrating a cover member and a sealing member of a washing machine according to another embodiment of the present disclosure, and FIG. 7 is a cross-sectional view illustrating a cover member and a sealing member of a washing machine according to another embodiment of the present disclosure.

Referring to FIG. 6, a sealing member 301 may be further easily coupled to the cover member 200 through a conventional adhesive. That is, when an adhesive surface 400 is formed on the upper flange 210 of the cover member 200 by the adhesive, the body 310 may be adhered to the adhesive surface 400.

Alternatively, referring to FIG. 7, a sealing member 302 may be fitted to the upper flange 210 of the cover member 200. That is, a coupling groove 212 formed to be concave downward may be provided on the upper flange 210, and a lower portion of the body 310 may be formed in a shape corresponding to the coupling groove 212 to be coupled to the coupling groove 212. Thus, the sealing member 302 may be fixed to the upper flange 210 more stably.

Figure 8:
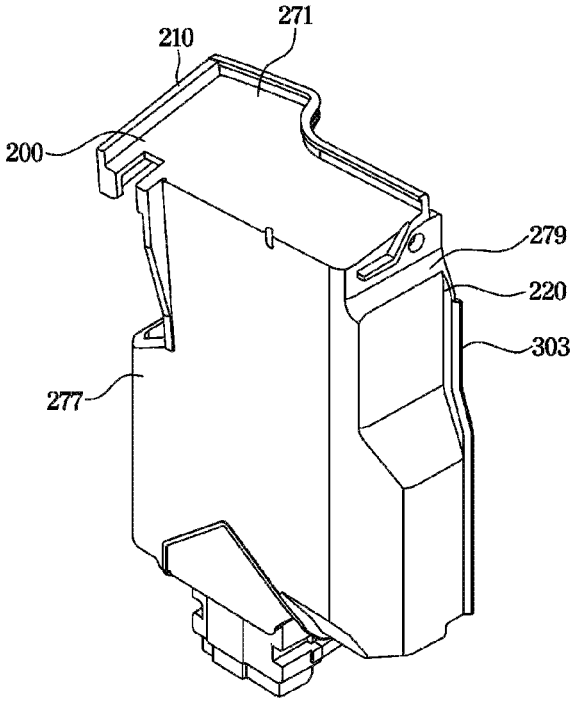
FIG. 8 is a perspective view illustrating a cover member and a sealing member of a washing machine according to another embodiment of the present disclosure.

FIG. 8 is a perspective view illustrating a cover member and a sealing member of a washing machine according to another embodiment of the present disclosure.

As illustrated in FIG. 8, a sealing member 303 of a washing machine 2 may be provided to seal a gap between at least one of the opposite side surfaces 277 and 279 of the cover member 200 and the rear surface of the front panel 10*b*.

That is, as illustrated in the drawing, the sealing member 303 may be provided to seal a gap between the second side surface 279 of the first and second side surfaces 277 and 279 of the cover member 200 and the rear surface of the front panel 10*b*. However, the present disclosure is not limited thereto, and the sealing member 303 may be provided to seal a gap between the first side surface 277 and the rear surface of the front panel 10*b*, and may be provided on each of the first side surface 277 and the second side surface 279 to seal both the gap between the first side surface 277 and the rear surface of the front panel 10*b* and the gap between the second side surface 277 and the rear surface of the front panel 10*b*.

A lower flange 220 provided to face the rear surface of the front panel 10*b* may be formed on one side of the first side surface 277 or the second side surface 279 of the cover member 200. As the sealing member 303 is coupled to the lower flange 220, the sealing member 303 may prevent water from penetrating into a gap between the lower flange 220 and the rear surface of the front panel 10*b*.

In this case, the sealing member 303 may be insert-injected onto the lower flange 220 of the cover member 200 through a conventional insert injection molding apparatus, or alternatively, may be adhered to the lower flange 220 through an adhesive, and may be fitted into the lower flange 220 by being inserted into a coupling groove (not shown) formed on the lower flange 220.

Further, although not illustrated in the drawing, the sealing member 303 may be provided on both the upper flange 210 and the lower flange 220 of the cover member 200 to seal both the gap between the upper flange 210 and the front panel 10*b* and the gap between the lower flange 220 and the front panel 10*b*.

As described above, when water is introduced into the washing machine 1 as the user sprays water toward the exterior of the washing machine 1 to clean the exterior of the washing machine 1, the washing machine 1 of the present disclosure may fundamentally block the inflow of water into the door-lock S, thereby preventing safety accidents such as fire due to contact between water and the door-lock S.

Figure 9:
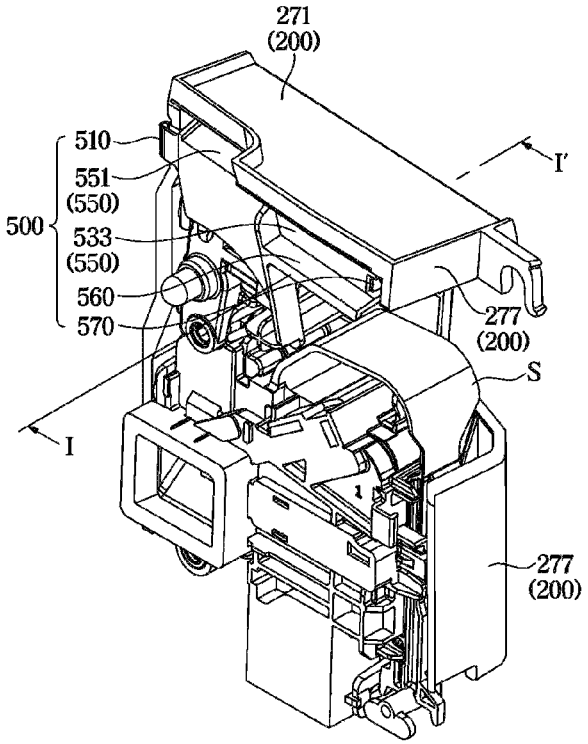
FIG. 9 is a perspective view illustrating a cover member, an auxiliary cover, and a door-lock of a washing machine according to another embodiment of the present disclosure.
Figure 10:
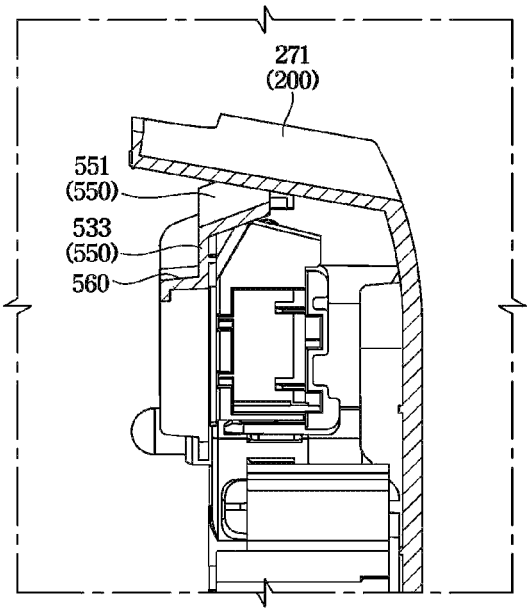
FIG. 10 is a cross-sectional view taken along line I-I' of FIG. 9.
Figure 11:
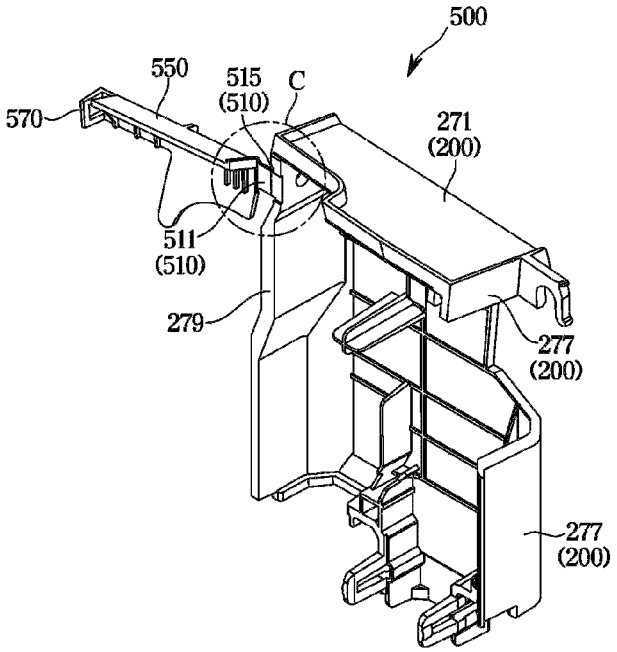
FIG. 11 is a perspective view illustrating the cover member and the auxiliary cover of FIG. 7.
Figure 12:
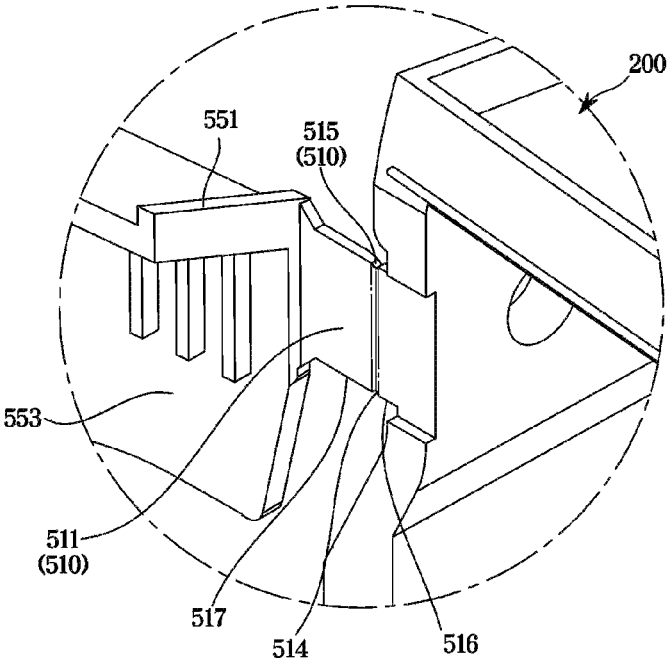
FIG. 12 is an enlarged view illustrating a part 'C' of FIG. 11.
Figure 13:
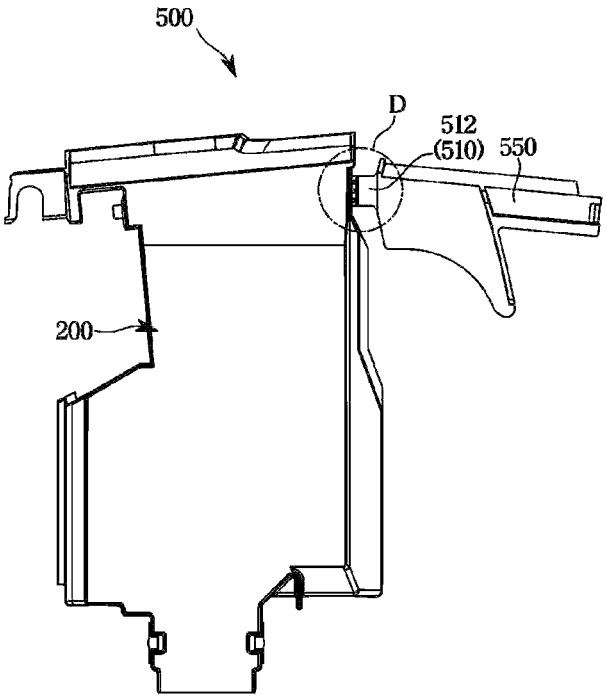
FIG. 13 is a perspective view of the cover member and the auxiliary cover of FIG. 7 viewed from a different angle.
Figure 14:
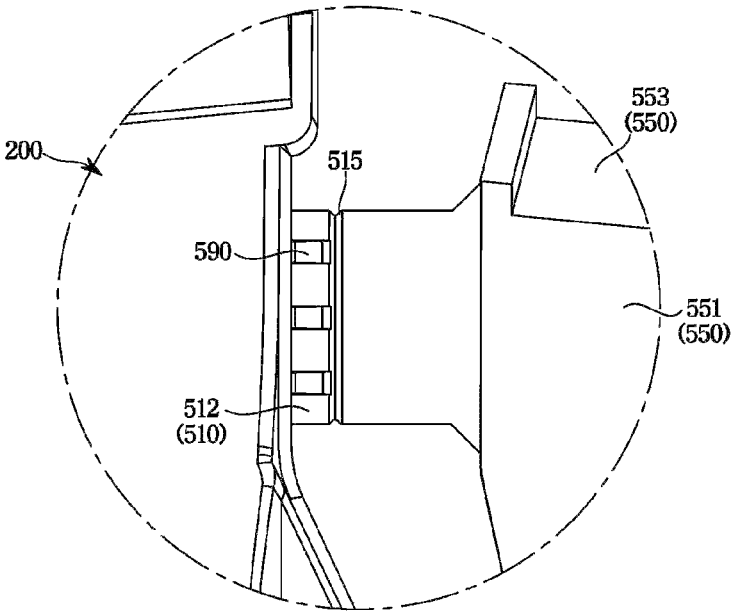
FIG. 14 is an enlarged view illustrating a part 'D' of FIG. 13.

FIG. 9 is a perspective view illustrating a cover member, an auxiliary cover, and a door-lock of a washing machine according to another embodiment of the present disclosure, FIG. 10 is a cross-sectional view taken along line I-I' of FIG. 9, FIG. 11 is a perspective view illustrating the cover member and the auxiliary cover of FIG. 7, FIG. 12 is an enlarged view illustrating a part 'C' of FIG. 11, FIG. 13 is a perspective view of the cover member and the auxiliary cover of FIG. 7 viewed from a different angle, and FIG. 14 is an enlarged view illustrating a part 'D' of FIG. 13.

Referring to FIGS. 9 and 10, the washing machine 1 further includes an auxiliary cover 500 coupled to the cover member 200.

The auxiliary cover 500 may be connected to one side surface of the cover member 200. The auxiliary cover 500 may be provided to be foldable with respect to the cover member 200. The auxiliary cover 500 may be provided to be folded or unfolded with respect to the cover member 200.

The cover member 200 and the auxiliary cover 500 may be manufactured by injection molding to enable mass production, thereby reducing production costs. The cover member 200 and the auxiliary cover 500 may be provided integrally.

The door-lock S may be positioned inside the cover member 200 in a state in which the auxiliary cover 500 is unfolded with respect to the cover member 200, and when the door-lock S is positioned, the auxiliary cover 500 may be folded with respect to the cover member 200 to prevent from the water fallen from the upper end of the cover member 200 into being introduced into the door-lock S.

The auxiliary cover 500 may be positioned inside the cover member 200 when a connection part 510, which will be described later, is folded, to be positioned below the upper end of the cover member 200. Accordingly, the water fallen to the cover member 200 through the gap between the front panel 10*b* and the control panel 80 is blocked from the flow by the auxiliary cover 500, so that the water may not be introduced into the door-lock S. That is, the water flowed along the upper end of the cover member 200 may not penetrate into the door-lock S by an upper end of the auxiliary cover 500.

More specifically, the auxiliary cover 500 may include the connection part 510 provided to be foldable on one side surface of the cover member 200, and an auxiliary part 550 connected to the connection part 510 to block the penetration of water into the door-lock when the connection part 510 is folded.

The connection part 510 may be coupled to the one side surface 279 of the cover member 200 as illustrated in the drawing, or alternatively, to the other side surface 277 of the cover member 200. However, when a portion of the other side surface 277 of the cover member 200 is cut to accommodate the door-lock S as illustrated in the drawing, it may be appropriate for the connection part 510 to be coupled to the one side surface 277 of the cover member 200 to ensure structural stability.

Referring to FIGS. 11 and 12, the connection part 510 includes a bent portion 514 provided on one side and first and second extension portions 516 and 517 provided on opposite sides of the bent portion 514.

The bent portion 514 is provided between the first extension portion 516 and the second extension portion 517, the first extension portion 516 is connected to a side surface 579 of the cover member 200, and the second extension portion 517 is connected to the auxiliary part 550.

The bent portion 514 may have a thickness smaller than a thickness of each of the first and second extension portions 516 and 517. Thus, the connection part 510 may be more easily folded around the bent portion 514, and in a state in which the connection part 510 is folded around the bent portion 514, the auxiliary cover 500 may be positioned below the upper end of the cover member 200 to block water from penetrating into the door-lock S.

The bent portion 514 may include a groove 515. The groove 515 may be provided on one surface 511 of the connection part 510. The groove 515 may be provided in a U-shape or a V-shape. The connection part 510 may be folded to face the rear surface of the cover member 200 around the groove 515 from a state of being unfolded with respect to the cover member 200 as illustrated in FIG. 11.

Referring back to FIGS. 9 and 10, the auxiliary part 550 includes an upper plate 551 and a front plate 553 extending from one end of the upper plate 551. When the auxiliary cover 500 is folded, the upper plate 551 may be positioned to face the upper surface 271 of the cover member 200, and the front plate 553 may be positioned to face the front panel 10*b*.

The upper plate 551 may be provided to cover an upper end of the door-lock S. The upper plate 551 may be provided to be inclined upward toward the rear surface of the cover member 200. Thus, the water fallen from the upper surface 271 of the cover member 200 may move to the front plate 553 along the upper surface plate 551.

A protrusion 570 protruding toward a front surface of the front plate 553 to prevent from the water flowed along the upper plate 551 to fall may be provided at an end of the front plate 553.

As illustrated in FIG. 10, the water flowed along the upper surface of the cover member 200 by falling to the cover member 200 through the gap between the front panel 10*b* and the control panel 80 may fall to the upper plate 551 of the auxiliary part 550, and the water fallen to the upper plate 551 may move to the protrusion 560 of the front plate 553 along the upper plate 551. As the upper plate 551 covers the upper end of the door-lock S and the protrusion 560 is formed to protrude from the end of the front plate 553, even when water falls from the protrusion 560, the water may not penetrate into the door-lock S.

Referring to FIGS. 13 and 14, the washing machine may further include a rib 590 to connect the other surface 512 of the connection part 510 and the side surface 279 of the cover member 200. The rib 590 may be provided to connect from the side surface of the cover member 200 to a position at the other surface 512 of the connection part 510, which corresponds to the groove 515 provided on the connection part 510. Thus, the rib 590 may serve to not only assist the connection part 510 to be easily folded around the groove 515, but also serve to reinforce the strength of the connection part 510. The present disclosure exemplifies that three of the ribs 590 are provided, but the number of ribs 590 is not limited thereto.

Referring back to FIGS. 9 and 11, the auxiliary part 550 may further include a hook member 570 connected to the front plate 553. The hook member 570 is coupled to a protrusion (not shown) provided on the other side surface

277 of the cover member 200 when the connection part 510 is folded, so that the auxiliary cover 500 may be fixed to the cover member 200.

Figure 15:
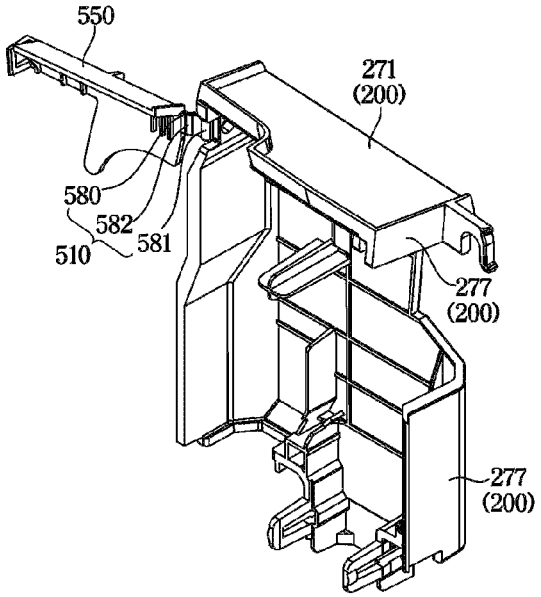
FIG. 15 is a perspective view illustrating a cover member and an auxiliary cover of a washing machine according to another embodiment of the present disclosure.
Figure 16:
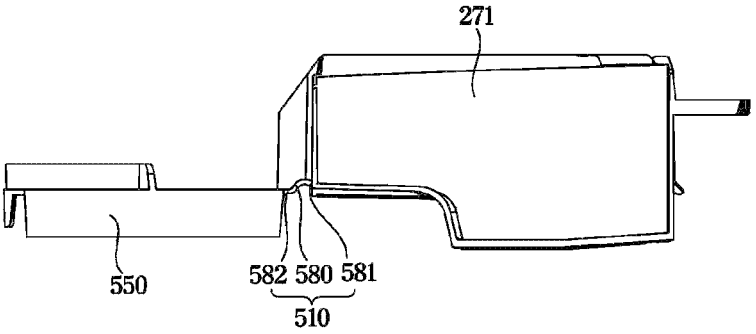
FIG. 16 is a plan view of the cover member and the auxiliary cover of FIG. 15 viewed from above.

FIG. 15 is a perspective view illustrating a cover member and an auxiliary cover of a washing machine according to another embodiment of the present disclosure, and FIG. 16 is a plan view of the cover member and the auxiliary cover of FIG. 15 viewed from above.

Referring to FIGS. 15 and 16, the connection part 510 may include a bent portion 580 having a semicircle or arc shape, and first and second extension portions 581 and 582 connected to opposite ends of the bent portion 580.

The bent portion 580 is provided between the first extension portion 581 and the second extension portion 582, the first extension portion 581 is connected to the side surface 579 of the cover member 200, and the second extension portion 582 is connected to the auxiliary part 550.

When the connection part 510 is folded to be positioned below the upper end of the cover member 200, the connection part 510 may be folded around the bent portion 580. In this case, as the connection part 510 is folded around the bent portion 580 having a semicircle or arc shape, the connection part 510 may be prevented from being deformed or broken by being bent.

The embodiments disclosed with reference to the accompanying drawings have been described above. However, it will be understood by those skilled in the art that various changes in form and details may be made therein without departing from the spirit and scope of the disclosure as defined by the appended claims.

What is claimed is:

1. A washing machine comprising:

a cabinet comprising a front panel in which a laundry inlet is formed;

a door rotatably coupled to the front panel to open and close the laundry inlet;

a door-lock disposed on a rear of the front panel and couplable with the door to maintain the door in a closed state;

a cover member including an upper surface covering an upper end of the door-lock, and an upper flange facing the rear surface of the front panel on a side of the upper surface, the cover member mounted on a rear surface of the front panel to cover the door-lock; and a sealing member including a body coupled to the upper flange, and a lip formed integrally with the body and inclined upward toward the rear surface of the front panel, and sealing a gap between the cover member and the rear surface of the front panel.

2. The washing machine according to claim 1, wherein the lip forms a first angle with respect to the body.

3. The washing machine according to claim 2, wherein the lip is deformed as the lip comes into contact with the rear surface of the front panel to form a second angle smaller than the first angle with respect to the body and to be in close contact with the rear surface of the front panel.

4. The washing machine according to claim 2, wherein the first angle is formed in a range of 120 degrees to 135 degrees.

5. The washing machine according to claim 1, wherein each of the body and the lip has a thickness of 1 mm.

6. The washing machine according to claim 1, wherein the sealing member is insert-injected onto the upper flange.

7. The washing machine according to claim 1, wherein the body is adhered to the upper flange through an adhesive.

8. The washing machine according to claim 1, wherein a coupling groove is formed on the upper flange to allow the body to be fitted to the upper flange.

9. The washing machine according to claim 1, wherein the cover member comprises a side surface covering a side of the door-lock, and a lower flange facing the rear surface of the front panel on a side of the side surface.

* * * * *